US008991209B2

(12) United States Patent
Tomita et al.

(10) Patent No.: US 8,991,209 B2
(45) Date of Patent: Mar. 31, 2015

(54) PROCESS AND INSTALLATION FOR PRODUCING HIGH-PRESSURE NITROGEN

(75) Inventors: Shinji Tomita, Ohkubo-cho (JP); Kouhei Nakamura, Uozumicho-Shimizu (JP); Kenji Hirose, Kakogawatyo (JP); Jerome Beauvisage, Tarumi-Ku (JP); Bao Ha, San Ramon, CA (US)

(73) Assignee: L'Air Liquide Societe Anonyme pour l'Etude et l'Exploitation des Procedes Georges Claude, Paris (FR)

( * ) Notice: Subject to any disclaimer, the term of this patent is extended or adjusted under 35 U.S.C. 154(b) by 1143 days.

(21) Appl. No.: 12/965,958

(22) Filed: Dec. 13, 2010

(65) Prior Publication Data

US 2012/0144861 A1 Jun. 14, 2012

(51) Int. Cl.
*F25J 3/00* (2006.01)
*F25J 3/04* (2006.01)

(52) U.S. Cl.
CPC ..... *F25J 3/04412* (2013.01); *F25J 3/04048* (2013.01); *F25J 3/04212* (2013.01); (Continued)

(58) Field of Classification Search
CPC ... F25J 2270/06; F25J 2230/08; F25J 3/0257; F25J 3/04; F25J 3/04054; F25J 3/0406; F25J 3/04084; F25J 3/0409; F25J 3/04309; F25J 3/04351; F25J 3/04363; F25J 3/04412; F25J 3/04418; F25J 2200/04; F25J 2200/06; F25J 2200/40; F25J 2200/42; F25J 2230/30; F25J 2230/32; F25J 2230/40; F25J 2230/42; F25J 2240/12; F25J 3/04315
USPC ..... 62/648, 649, 650, 651, 652, 653, 654
See application file for complete search history.

(56) References Cited

U.S. PATENT DOCUMENTS 4,717,410 A 1/1988 Grenier
5,421,166 A * 6/1995 Allam et al. ..... 62/649
(Continued)

FOREIGN PATENT DOCUMENTS

DE 10339217 3/2005

OTHER PUBLICATIONS

EP11191763, European Search Report, Feb. 16, 2012.

*Primary Examiner* — John F Pettitt
*Assistant Examiner* — Ignacio E Landeros
(74) *Attorney, Agent, or Firm* — Justin K. Murray; Elwood L. Haynes

(57) ABSTRACT

A method and apparatus for producing high pressure nitrogen is provided. This system includes a first compressor for compressing air and cooling air to substantially the dew-point, a high pressure column, a medium pressure column, a conduit for introducing at least a portion of the compressed air at a base of the high pressure column; a conduit for removing a oxygen enriched liquid from the base of the high pressure column; a first valve for reducing the pressure of the oxygen enriched liquid to a medium pressure, where the medium pressure is between the high pressure and atmospheric pressure, a conduit for introducing the oxygen enriched liquid at an intermediate place of the medium pressure column; a second expander for reducing the pressure of at least a part of the liquid removed from the base of the medium pressure distillation column, to a low pressure to cool a top condenser of the medium pressure column and to form a waste vapor stream; a cold compressor for compressing a vapor stream removed form the medium pressure column, cooling the compressed vapor stream, and introducing it into the base of the high pressure column; a heat exchanger for heating the waste vapor stream, a first expander for expanding the heated stream to produce power; a conduit for withdrawing liquid from the top of the medium pressure column, pump for pumping the withdrawn liquid to high pressure and injecting it at the top of the high pressure column; and conduit for withdrawing product nitrogen from the top of the high pressure column.

9 Claims, 2 Drawing Sheets

(52) U.S. Cl.
CPC ..... *F25J3/04321* (2013.01); *F25J 3/04393* (2013.01); *F25J 3/0486* (2013.01); *F25J 3/04333* (2013.01); *F25J 2200/40* (2013.01); *F25J 2230/08* (2013.01); *F25J 3/0406* (2013.01); *F25J 3/04309* (2013.01); *F25J 3/04315* (2013.01); *F25J 2200/54* (2013.01); *F25J 2235/42* (2013.01); *F25J 2245/02* (2013.01); *F25J 2245/42* (2013.01)
USPC ..... 62/650

(56) References Cited

U.S. PATENT DOCUMENTS

| | | | | |
|---|---|---|---|---|
| 5,475,980 | A | 12/1995 | Grenier et al. | |
| 6,196,023 | B1 | 3/2001 | Corduan et al. | |
| 6,257,019 | B1 * | 7/2001 | Oakey et al. | 62/646 |
| 6,484,533 | B1 * | 11/2002 | Allam et al. | 62/643 |
| 2001/0032480 | A1 | 10/2001 | Mostello | |

* cited by examiner

PROCESS AND INSTALLATION FOR PRODUCING HIGH-PRESSURE NITROGEN

BACKGROUND

In installations for producing nitrogen under pressure, the nitrogen is usually produced directly at the pressure of use, for example between 5 and 10 bars. Purified air, compressed slightly above this pressure, is distilled so as to produce the nitrogen at the top of the column and the reflux is achieved by expansion of the "oxygen enriched liquid" (liquid at the base of the column formed by air enriched with oxygen) and cooling of the condenser at the top of the column by means of this expanded liquid. The oxygen enriched liquid is thus vaporized at a pressure of between about 3 and 6 bars.

If the size of the installation justifies this, the vaporized oxygen enriched liquid is passed through an expander so as to maintain the installation in the cold state but, often, this refrigerating production is excessive, which corresponds to a loss of energy. In the opposite hypothesis, the cold state is maintained by an addition of liquid nitrogen coming from an exterior source, and the vaporized oxygen enriched liquid is simply expanded in a valve and then travels through the thermal heat exchanger serving to cool the initial air. Consequently, here again, a part of the energy of the vaporized oxygen enriched liquid is lost.

While the invention disclosed in U.S. Pat. No. 4,717,410 (hereinafter referred to as "the Grenier cycle") is very effective for producing high pressure nitrogen, in order to meet the customer demand for the high-pressure nitrogen product in recent years, even if the Grenier cycle is utilized, boosting product nitrogen by the addition of a nitrogen compressor is often necessary. One alternative is that high pressure nitrogen can be supplied by increasing the top condenser pressure. However this method deteriorates the recovery ratio, as well as the specific power.

In FIG. 2 of the Grenier patent, gas is withdrawn from the lower part of the column and sent to the expander. Because the gas composition is similar to air composition, this means this method deteriorates the nitrogen recovery ratio.

An object of the invention is to provide a process and apparatus to permit the production of high pressure nitrogen with high recovery ratio without an additional nitrogen compressor.

SUMMARY

A method and apparatus for producing high pressure nitrogen is provided. This system includes a first compressor for compressing air and cooling air to substantially the dew-point, a high pressure column, a medium pressure column, a conduit for introducing at least a portion of the compressed air at a base of the high pressure column; a conduit for removing a oxygen enriched liquid from the base of the high pressure column; a first valve for reducing the pressure of the oxygen enriched liquid to a medium pressure, where the medium pressure is between the high pressure and atmospheric pressure, a conduit for introducing the oxygen enriched liquid at an intermediate place of the medium pressure column; a second valve for reducing the pressure of at least a part of the liquid removed from the base of the medium pressure distillation column, to a low pressure to cool a top condenser of the medium pressure column and to form a waste vapor stream; a cold compressor for compressing a vapor stream removed from the medium pressure column, cooling the compressed vapor stream, and introducing it into the base of the high pressure column; a heat exchanger for heating the waste vapor stream, a first expander for expanding the heated stream to produce power; a conduit for withdrawing liquid from the top of the medium pressure column, pump for pumping the withdrawn liquid to high pressure and injecting it at the top of the high pressure column; and conduit for withdrawing product nitrogen from the top of the high pressure column.

DESCRIPTION OF PREFERRED EMBODIMENTS

Figure 1:
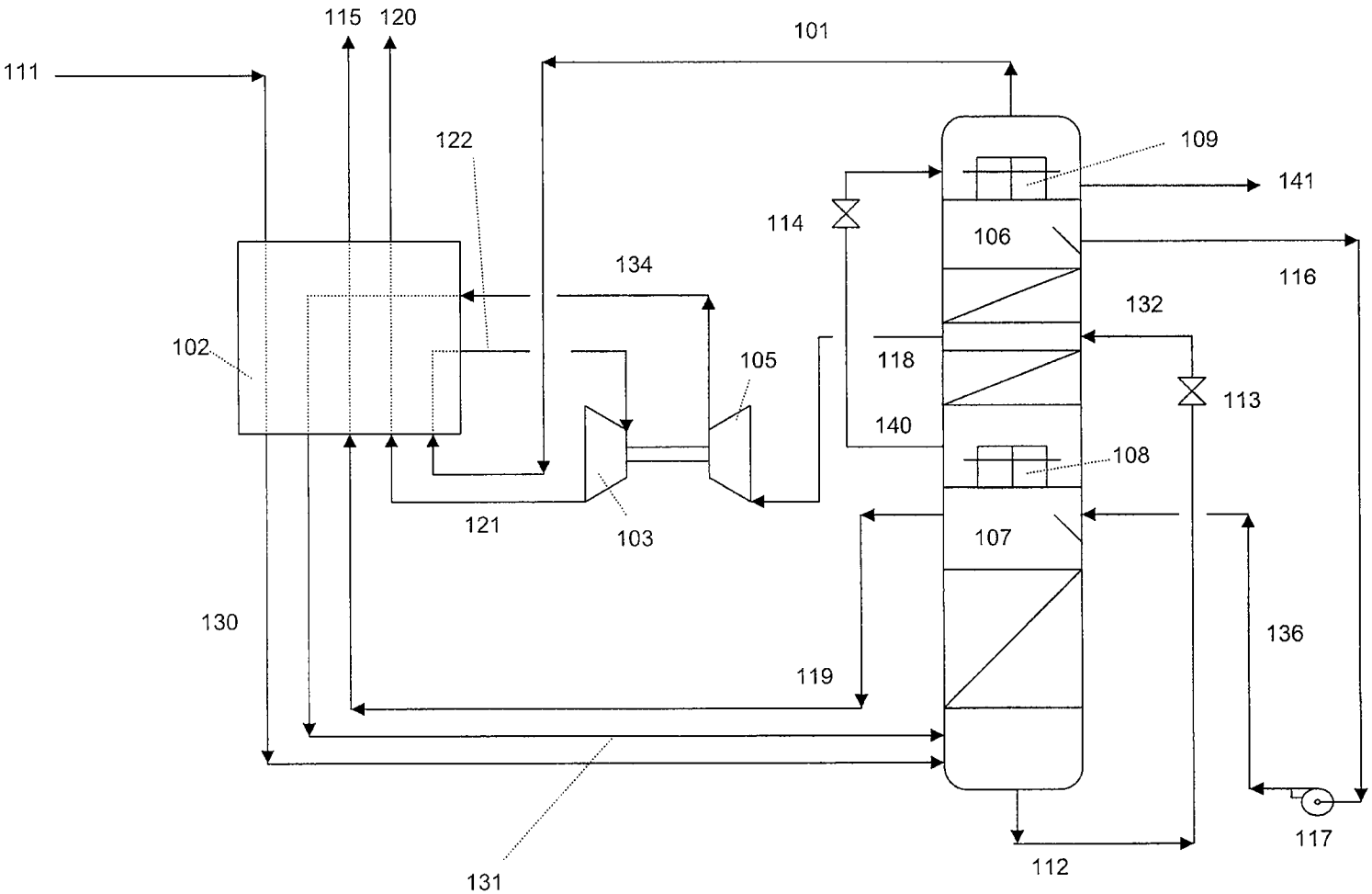
FIG. 1 illustrates a single expander embodiment, in accordance with one embodiment of the present invention.

Illustrative embodiments of the invention are described below. While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The current invention provides a process and apparatus to solve aforementioned drawbacks. As explained above, higher pressure nitrogen can be supplied by increasing top condenser pressure. However, higher system pressure also results in reduced recovery of nitrogen because the distillation columns are less efficient at higher pressure. Referring to FIG. 1, waste gas is withdrawn from the top of column by a conduit 101, heated through the exchanger 102 to a suitable temperature level then expanded in expander 103 and again introduced into exchanger 102, after which it leaves the system as waste 120. At higher waste gas pressure, less waste gas is needed to achieve the thermal equilibrium since the waste gas expander 103 operates at higher pressure ratio. Therefore, for the system to achieve the improved performance, the product nitrogen recovery ratio must be improved at higher pressure when compared to the Grenier cycle. This increase in recovery ratio reduces the waste gas flow allowing the system to reach an optimum thermal equilibrium. Therefore, by providing an improved nitrogen recovery at higher pressure, the present system is suitable for producing high pressure nitrogen efficiently without using an additional nitrogen product compressor.

Also, in the present invention, oxygen rich gas (waste gas) is withdrawn from the top condenser by a conduit 101 and sent to expander 103 in order to achieve thermal equilibrium or refrigeration balance of the process. Because oxygen rich gas is used for thermal equilibrium, it does not alter the product nitrogen recovery ratio. Preferably, by adopting expander 103, at least a portion of the work output from expander 103 may be used to operate the cold nitrogen compressor 105. A gas whose composition is close to air is withdrawn from the medium pressure distillation column 106. The gas is sent to the aforementioned cold nitrogen compressor 105 and pressurized to approximately the same pressure as the high pressure column 107. Pressurized gas is then introduced into the bottom of the high pressure distillation column 107 in order to improve product nitrogen recovery ratio. By improving product nitrogen recovery ratio, a reduction in manufacturing cost may be achieved One embodiment of the present invention pertains to an installation with a expander 103, a heat exchanger 102 and a double distillation column 106, 107. The distillation column is formed by a lower main column 107 operating at high pressure, i.e. at the production pressure, about 10 bars, and an upper auxiliary column 106 operating at a medium pressure, about 5 bars. Each of these columns has a top condenser 108, 109 respectively.

In FIG. 1, compressed air 111, free of moisture and carbon dioxide is cooled to about its dewpoint through the heat exchanger 102 and introduced at the base of the column 107. The oxygen enriched liquid 112, in equilibrium with the inlet air received at the base of the column 107, is reduced in pressure to the medium pressure in an expansion valve 113 and introduced at an intermediate point of column 106. In the medium pressure column 106, the descending liquid is enriched in oxygen and cools the main condenser 108 at the base of the column 106, to ensure the reflux in the column 107. The bottom liquid 140 of column 106 is reduced in pressure in an expansion valve 114 and then serves to cool the top condenser 109 and ensure the reflux in the column 106.

The liquid 140, is vaporized in condenser 109 at a pressure of about 1.7 barg, to form stream 101, which is then warmed in heat exchanger 102 and then expanded in expander 103 to provide the refrigeration balance needed for achieving the thermal equilibrium. After the expansion, the gas is then warmed in exchanger line 102 so as to constitute the residual gas 120 of the installation.

A fraction of the condensed flow of condenser 109 is withdrawn from column 106 by a conduit 116 and brought back by a pump 117 to the high pressure and re-injected at the top of column 107.

A gaseous stream with a composition close to air is withdrawn from the column 106 and sent by a conduit 118 to cold compressor 105 and pressurized to slightly above the pressure of the high pressure column 107. As used herein, the term "cold compression" means the method of mechanically raising the pressure of a gas stream that is lower in temperature than the ambient level feeds to the cryogenic separation system and returned to the system at a sub ambient temperature. The gaseous stream withdrawn from column 106 and sent to cold compressor 105 may be withdrawn at an intermediate point at the same level as oxygen enriched liquid 112 was introduced. The mechanical energy of cold compression must be balanced by refrigeration The gas is then cooled by the heat exchanger 102, and introduced to bottom of distillation column 107 in order to improve product nitrogen recovery.

The gaseous nitrogen stream 119 is withdrawn from the top of column 107, warmed in heat exchanger 102 and recovered as nitrogen product.

In one embodiment of the present invention, this apparatus comprises a heat exchanger 102 for cooling feed air to substantially the dew-point thereof, a high pressure distillation column 107, a medium pressure distillation column 106. This invention also includes a conduit 130 for introducing at least a portion of said cooled compressed air at a base of said high pressure distillation column 107, a conduit 112 for removing a oxygen enriched liquid from the base of said high pressure distillation column, a first valve 113 for reducing the pressure of said oxygen enriched liquid to a medium pressure, wherein said medium pressure is between said high pressure and atmospheric pressure. The apparatus also comprises a conduit 132 for introducing said oxygen enriched liquid at an intermediate place of said medium pressure distillation column 106; a second valve 114 for reducing the pressure of at least a part of a liquid removed from the base of said medium pressure distillation column 106, to a low pressure to cool a top condenser of said medium pressure distillation column and to form a waste vapor stream 101. A THC purge stream 141 also is removed from the top condenser of said medium pressure distillation column. This invention includes a cold compressor 105 for compressing a vapor stream 118 removed from the medium pressure distillation column 106, a heat exchanger 102 for cooling said compressed vapor stream, and a conduit 131 for introducing it into the base of said high pressure distillation column. The apparatus also comprises a heat exchanger 102 for heating said waste vapor stream, a first expander 103 for expanding said heated stream to produce power; a conduit 116 for withdrawing liquid from the top of said medium pressure distillation column 106, a pump 117 for pumping said withdrawn liquid to said high pressure and injecting it at the top of the high pressure distillation column 107; and a conduit 119 for withdrawing product nitrogen from the top of the high pressure distillation column.

A non-limiting example of one embodiment of the above invention follows:

First Embodiment with a Nominal 0.82 MPaG Air Inlet Pressure

| Stream: | 111 | 130 | 112 | 119 | 115 | 118 | 134 | 131 |
|---|---|---|---|---|---|---|---|---|
| Flow rate (Nm3/hr) | 1000 | 1000 | 621 | 607 | 607 | 58 | 58 | 58 |
| Pressure (MPaG) | 0.85 | 0.84 | 0.84 | 0.83 | 0.82 | 0.432 | 0.84 | 0.83 |
| Temperature (C.) | 55 | −166 | −166 | −171 | 53 | −175 | −153 | −166 |
| Nitrogen (%) | 78.1 | 78.1 | 63.1 | 100.0 | 100 | 82.3 | 82.3 | 82.3 |
| Argon (%) | 0.9 | 0.9 | 1.6 | 0.0 | 0.0 | 1.1 | 1.1 | 1.0 |
| Oxygen (%) | 21.0 | 21.0 | 35.3 | 0.0 | 0.0 | 16.6 | 16.6 | 16.6 |

| Stream: | 116 | 136 | 114 | 101 | 122 | 121 | 120 | 141 |
|---|---|---|---|---|---|---|---|---|
| Flow rate (Nm3/hr) | 169 | 169 | 393 | 391 | 391 | 391 | 391 | 2 |
| Pressure (MPaG) | 0.42 | 0.83 | 0.43 | 0.10 | 0.10 | 0.03 | 0.01 | 0.10 |
| Temperature (C.) | −179 | −178 | −172 | −180 | −145 | −158 | 53 | −180 |

-continued

| | | | | | | | | |
|---|---|---|---|---|---|---|---|---|
| Nitrogen (%) | 100.0 | 100.0 | 44.3 | 44.6 | 44.6 | 44.6 | 44.6 | 19.0 |
| Argon (%) | 0.0 | 0.0 | 2.4 | 2.4 | 2.4 | 2.4 | 2.4 | 2.4 |
| Oxygen (%) | 0.0 | 0.0 | 53.3 | 53.2 | 53.2 | 53.2 | 53.2 | 78.6 |

First Embodiment with a Nominal 1.00 MPaG Air

Inlet Pressure

| Stream: | 111 | 130 | 112 | 119 | 115 | 118 | 134 | 131 |
|---|---|---|---|---|---|---|---|---|
| Flow rate (Nm3/hr) | 1000 | 1000 | 735 | 614 | 614 | 197 | 197 | 197 |
| Pressure (MPaG) | 1.04 | 1.03 | 1.03 | 1.02 | 1.01 | 0.54 | 1.03 | 1.02 |
| Temperature (C.) | 55 | −163 | −163 | −168 | 53 | −172 | −151 | −163 |
| Nitrogen (%) | 78.1 | 78.1 | 64.6 | 100.0 | 100 | 82.7 | 82.7 | 82.7 |
| Argon (%) | 0.9 | 0.9 | 1.5 | 0.0 | 0.0 | 1.0 | 1.0 | 1.0 |
| Oxygen (%) | 21.0 | 21.0 | 32.9 | 0.0 | 0.0 | 16.3 | 16.3 | 16.3 |
| **Stream:** | **116** | **136** | **114** | **101** | **122** | **121** | **120** | **141** |
| Flow rate (Nm3/hr) | 152 | 152 | 386 | 384 | 384 | 384 | 384 | 2 |
| Pressure (MPaG) | 0.54 | 1.02 | 0.54 | 0.15 | 0.15 | 0.03 | 0.01 | 0.15 |
| Temperature (C.) | −176 | −176 | −169 | −178 | −140 | −159 | 53 | −178 |
| Nitrogen (%) | 100.0 | 100.0 | 43.3 | 43.4 | 43.4 | 43.4 | 43.4 | 19.2 |
| Argon (%) | 0.0 | 0.0 | 2.4 | 2.4 | 2.4 | 2.4 | 2.4 | 2.5 |
| Oxygen (%) | 0.0 | 0.0 | 54.3 | 54.2 | 54.2 | 54.2 | 54.2 | 78.3 |

One embodiment of the present invention pertains to an installation with a first expander 204, a second expander 203, a thermal heat exchanger 202 and a double distillation column 206, 207. The distillation column is formed by a lower main column 207 operating at high pressure, i.e. at the production pressure, about 10 bars, and an upper auxiliary column 206 operating at a medium pressure, about 5 bars. Each of these columns has a top condenser 208, 209 respectively.

Figure 2:
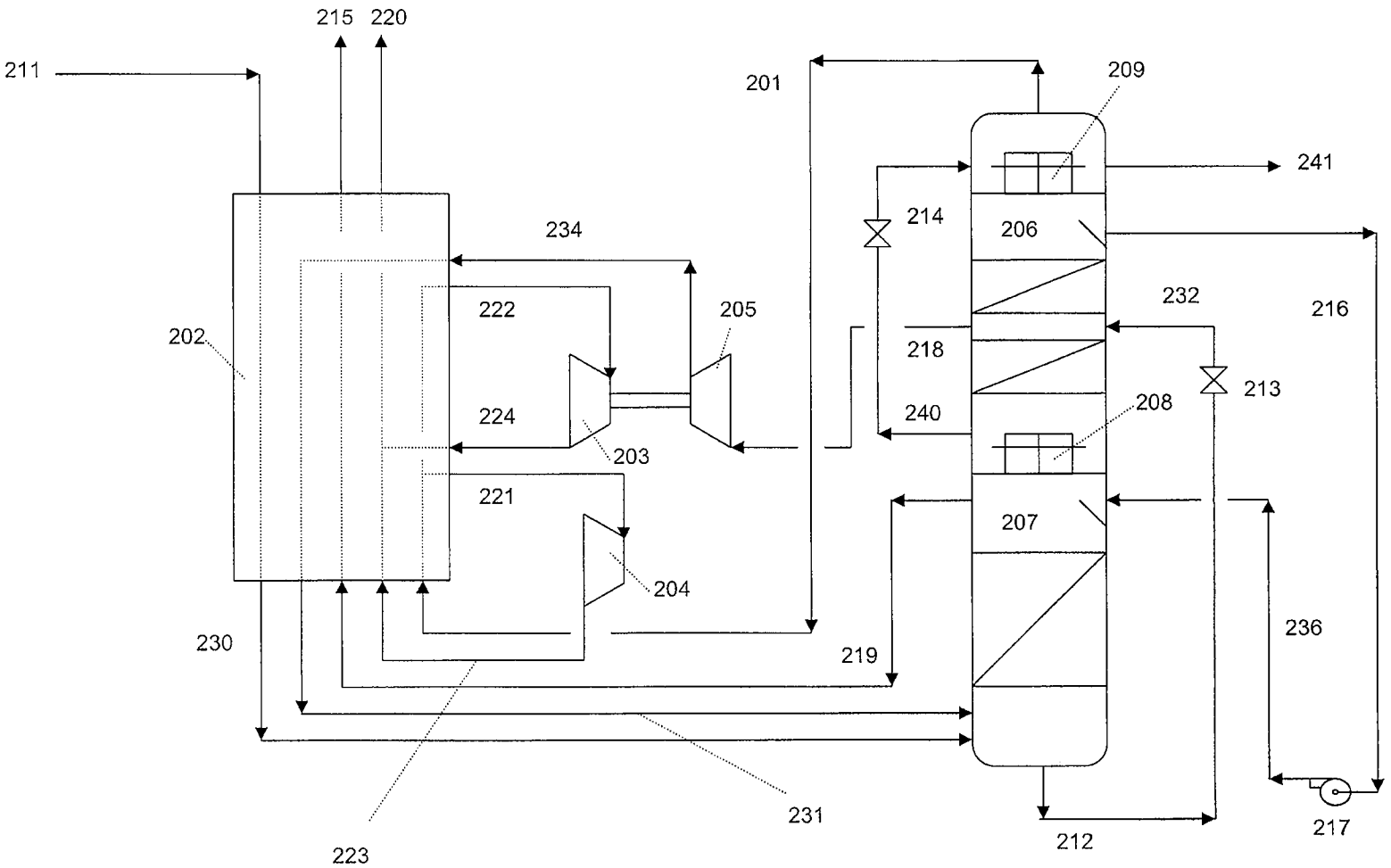
FIG. 2 illustrates a double expander embodiment, in accordance with one embodiment of the present invention

In FIG. 2, compressed air 211, free of moisture and carbon dioxide is cooled to about its dew point through the heat exchanger 202 and introduced at the base of the column 207. The oxygen enriched liquid 212, in equilibrium with the inlet air received at the base of the column 207, is reduced in pressure to the medium pressure in an expansion valve 213 and introduced at an intermediate point of column 206. In the medium pressure column 206, the descending liquid is enriched in oxygen and cools the main condenser 208 at the base of the column 206, to ensure the reflux in the column 207. The bottom liquid 240 of column 206 is reduced in pressure in an expansion valve 214 and then serves to cool the top condenser 209 and ensure the reflux in the column 206.

A gaseous stream with a composition close to air is withdrawn from the column 206 and sent by a conduit 218 to cold compressor 205 and pressurized to slightly above the pressure of the high pressure column 207. The gas is then cooled by the heat exchanger 202, and introduced to bottom of distillation column 207 in order to improve product nitrogen recovery. By improving product nitrogen recovery ratio, a reduction in manufacturing cost may be achieved Waste gas is withdrawn from the top condenser 209 by a conduit 201, heated in heat exchanger 202 to a suitable temperature level, a first portion of the waste gas 221 is expanded in a first expander 204, thereby producing a first expanded stream 223. A THC purge stream 241 also is removed from the top condenser of said medium pressure distillation column. And a second portion of the hot waste gas 222 is expanded in a second expander 203, thereby producing a second expanded stream 224. The temperature of the first portion 221 and the second portion 222 are not the same. In one embodiment, the temperature of the second portion 222 is greater than that of the first portion 221.

The first expanded line 223 and the second expanded line 224 can be recombined and again introduced into heat exchanger 202, after which it leaves the system as waste 220. At least a portion of the work output from second expander 203 (or first expander 204) may be used to operate the cold nitrogen compressor 205.

The liquid 240, is vaporized in condenser 209 at a pressure of about 1.7 barg, to form stream 201, which is then warmed in heat exchanger 202 and then expanded in expander 203 to provide the refrigeration balance needed for achieving the thermal equilibrium. After the expansion, the gas is then warmed in exchanger line 202 so as to constitute the residual gas 220 of the installation.

A fraction of the condensed flow of condenser 209 is withdrawn from column 206 by a conduit 216 and brought back by a pump 217 to the high pressure and re-injected at the top of column 207. The gaseous nitrogen stream 219 is withdrawn from the top of column 207, warmed in heat exchanger 202 and recovered as nitrogen product.

The skilled artisan will recognize that there are additional expander arrangements possible, and should not be limited to the scheme indicated in FIGS. 1 and 2. In addition to an improvement in the temperature level in the heat exchanger 202, the double expander arrangement also provides the advantage of higher inlet temperature to the second expander 203, which is beneficial from the aspect of its work output. Higher work output means more flow can be recycled and higher product recovery. It is also useful to note that in the scheme of FIG. 1, the excess refrigeration generated by the expander 103 and utilized to balance out the refrigeration required for the process can be dissipated, for example, in an integrated oil brake or generator brake (not shown).

In one embodiment of the present invention, this apparatus comprises a heat exchanger 202 for cooling feed air to substantially the dew-point thereof, a high pressure distillation column 207, and a medium pressure distillation column 206.

This invention also includes a conduit 230 for introducing at least a portion of said compressed air at a base of said high pressure distillation column; a conduit 212 for removing a oxygen enriched liquid from the base of said high pressure distillation column 207; and a first valve 213 for reducing the pressure of said oxygen enriched liquid to a medium pressure, wherein said medium pressure is between said high pressure and atmospheric pressure. The invention also includes a conduit 232 for introducing said oxygen enriched liquid at an intermediate place of said medium pressure distillation column 206; a second valve 214 for reducing the pressure of at least a part of a liquid removed from the base of said medium pressure distillation column, to a low pressure to cool a top condenser of said medium pressure distillation column 206 and to form a waste vapor stream. This invention also includes a cold compressor 205 for compressing a vapor stream removed form the medium pressure distillation column 206, cooling said compressed vapor stream, and introducing it into the base of said high pressure distillation column 207. This invention also includes a heat exchanger 202 for heating said waste vapor stream, a first expander 203 for expanding a portion of said heated stream to produce power; and a second expander 204 for expanding another portion of said heated stream to produce power. This invention also includes a conduit 216 for withdrawing liquid from the top of said medium pressure distillation column 206, a pump 217 for pumping said withdrawn liquid to said high pressure and injecting it at the top of the high pressure distillation column 207; and a conduit 219 for withdrawing product nitrogen from the top of the high pressure distillation column.

Second Embodiment with a Nominal 0.82 MPaG Air Inlet Pressure

| Stream: | 211 | 230 | 212 | 219 | 215 | 218 | 234 | 231 | 216 |
|---|---|---|---|---|---|---|---|---|---|
| Flow rate (Nm3/hr) | 1000 | 1000 | 630 | 612 | 612 | 74 | 74 | 74 | 167 |
| Pressure (MPaG) | 0.85 | 0.84 | 0.84 | 0.83 | 0.82 | 0.42 | 0.84 | 0.83 | 0.423 |
| Temperature (C.) | 55 | −166 | −166 | −171 | 53 | −175 | −153 | −166 | −179 |
| Nitrogen (%) | 78.1 | 78.1 | 63.2 | 100.0 | 100 | 82.3 | 82.3 | 82.3 | 100 |
| Argon (%) | 0.9 | 0.9 | 1.6 | 0.0 | 0.0 | 1.1 | 1.1 | 1.0 | 0.0 |
| Oxygen (%) | 21.0 | 21.0 | 35.2 | 0.0 | 0.0 | 16.6 | 16.6 | 16.6 | 0.0 |

| Stream: | 236 | 214 | 201 | 222 | 224 | 220 | 221 | 223 | 241 |
|---|---|---|---|---|---|---|---|---|---|
| Flow rate (Nm3/hr) | 167 | 388 | 386 | 75 | 75 | 386 | 311 | 311 | 2 |
| Pressure (MPaG) | 0.83 | 0.42 | 0.10 | 0.09 | 0.02 | 0.01 | 0.09 | 0.03 | 0.10 |
| Temperature (C.) | −178 | −172 | −180 | −63 | −83 | 53 | −148 | −160 | −180 |
| Nitrogen (%) | 100.0 | 43.6 | 43.8 | 43.8 | 43.8 | 43.8 | 43.8 | 43.8 | 18.5 |
| Argon (%) | 0.0 | 2.4 | 2.4 | 2.4 | 2.4 | 2.4 | 2.4 | 2.4 | 2.4 |
| Oxygen (%) | 0.0 | 54.0 | 53.8 | 53.8 | 53.8 | 53.8 | 53.8 | 53.8 | 79.1 |

Second Embodiment with a Nominal 1.00 MPaG Air Inlet Pressure

| Stream: | 211 | 230 | 212 | 219 | 215 | 218 | 234 | 231 | 216 |
|---|---|---|---|---|---|---|---|---|---|
| Flow rate (Nm3/hr) | 1000 | 1000 | 630 | 617 | 617 | 207 | 207 | 207 | 151 |
| Pressure (MPaG) | 1.04 | 1.03 | 1.03 | 1.02 | 1.01 | 0.54 | 1.03 | 1.02 | 0.53 |
| Temperature (C.) | 55 | −163 | −163 | −168 | 53 | −172 | −150 | −163 | −176 |
| Nitrogen (%) | 78.1 | 78.1 | 64.6 | 100.0 | 100 | 82.7 | 82.7 | 82.7 | 100 |
| Argon (%) | 0.9 | 0.9 | 1.5 | 0.0 | 0.0 | 1.0 | 1.0 | 1.0 | 0.0 |
| Oxygen (%) | 21.0 | 21.0 | 32.8 | 0.0 | 0.0 | 16.3 | 16.3 | 16.3 | 0.0 |

| Stream: | 236 | 214 | 201 | 222 | 224 | 220 | 221 | 223 | 241 |
|---|---|---|---|---|---|---|---|---|---|
| Flow rate (Nm3/hr) | 151 | 383 | 381 | 188 | 188 | 381 | 193 | 193 | 2 |
| Pressure (MPaG) | 1.02 | 0.54 | 0.15 | 0.149 | 0.02 | 0.01 | 0.15 | 0.03 | 0.15 |
| Temperature (C.) | −176.8 | −169.2 | −178 | −120 | −143 | 53 | −148 | −166 | −178 |
| Nitrogen (%) | 100.0 | 42.9 | 43.0 | 43.0 | 43.0 | 43.0 | 43.0 | 43.0 | 18.9 |
| Argon (%) | 0.0 | 2.4 | 2.4 | 2.4 | 2.4 | 2.4 | 2.4 | 2.4 | 2.5 |
| Oxygen (%) | 0.0 | 54.7 | 54.6 | 54.6 | 54.6 | 54.6 | 54.6 | 54.6 | 78.6 |

What is claimed is:

1. A process for producing high pressure nitrogen, the process comprising:

cooling feed air to substantially the dew-point thereof;

introducing at least a portion of said feed air at a base of a high pressure column;

removing an oxygen enriched liquid from the base of said high pressure column;

reducing the pressure of said oxygen enriched liquid in a first valve to a medium pressure;

wherein said medium pressure is between said high pressure and atmospheric pressure;

introducing said oxygen enriched liquid at an intermediate place of a medium pressure column;

reducing the pressure of at least a part of a liquid removed from the base of said medium pressure column in a second valve to a low pressure to cool a top condenser of said medium pressure column and to form a waste vapor stream;

compressing a vapor stream removed form the medium pressure column in a cold compressor, cooling said vapor stream, and introducing the vapor stream into the base of the high pressure column;

heating said waste vapor stream, and expanding said waste vapor stream in an expander to produce power, withdrawing a top liquid from the top of said medium pressure column;

pumping said top liquid to said high pressure and injecting it at the top of the high pressure column; and withdrawing product nitrogen from the top of the high pressure column.

2. The process of claim 1, wherein at least a portion of said power is used by said cold compressor.

3. An apparatus for producing high pressure nitrogen, the apparatus comprising:

a first heat exchanger having a first exchange line configured to cool feed air to substantially the dew-point thereof;

a high pressure distillation column;

a medium pressure distillation column;

a first conduit configured to introduce at least a portion of said cooled compressed air at a base of said high pressure distillation column;

a second conduit configured to remove an oxygen enriched liquid from the base of said high pressure distillation column;

a first valve configured to reduce the pressure of said oxygen enriched liquid to a medium pressure, wherein said medium pressure is between said high pressure and atmospheric pressure;

a third conduit configured to introduce said oxygen enriched liquid at an intermediate place of said medium pressure distillation column;

a second valve configured to reduce the pressure of at least a part of a liquid removed from the base of said medium pressure distillation column, to a low pressure to cool a top condenser of said medium pressure distillation column and to form a waste vapor stream;

a cold compressor configured to compress a vapor stream removed from the medium pressure distillation column;

a second heat exchanger having a warm end, a cool end, and an intermediate side, the second heat exchanger in fluid communication with the high pressure distillation column, the medium pressure distillation column, and the cold compressor, wherein the second heat exchanger is configured to heat said waste vapor stream, wherein the second heat exchanger is configured to cool the compressed vapor stream and then introduce the compressed vapor stream to the high pressure distillation column;

a first expander configured to expand said heated stream to produce power;

a fourth conduit configured to withdraw a top liquid from the top of said medium pressure distillation column;

a pump configured to pump said top liquid to said high pressure and introduce the top liquid at the top of the high pressure distillation column; and a fifth conduit configured to withdraw product nitrogen from the top of the high pressure distillation column.

4. The process of claim 1, wherein said oxygen enriched liquid is introduced at the same level as said vapor stream is removed from said medium pressure column and compressed in said cold compressor.

5. An apparatus for producing high pressure nitrogen, the apparatus comprising:

a heat exchanger having a first exchange line configured to cool a feed air to substantially the dew-point thereof;

a high pressure distillation column;

a medium pressure distillation column, a first conduit configured to introduce at least a portion of said compressed air at a base of said high pressure distillation column;

a second conduit configured to remove an oxygen enriched liquid from the base of said high pressure distillation column;

a first valve configured to reduce the pressure of said oxygen enriched liquid to a medium pressure, wherein said medium pressure is between said high pressure and atmospheric pressure;

a third conduit configured to introduce said oxygen enriched liquid at an intermediate place of said medium pressure distillation column;

a second valve configured to reduce the pressure of at least a part of a bottom liquid removed from the base of said medium pressure distillation column, to a low pressure to cool a top condenser of said medium pressure distillation column and to form a waste vapor stream;

a cold compressor configured to compress a vapor stream removed form the medium pressure distillation column, means for cooling said compressed vapor stream, and means for introducing the compressed vapor stream into the base of said high pressure distillation column;

a second exchange line configured to heat said waste vapor stream;

a first expander configured to expand a portion of said heated stream to produce power;

a second expander configured to expand another portion of said heated stream to produce power;

a fourth conduit configured to withdraw a top liquid from the top of said medium pressure distillation column;

a pump configured to pump the top liquid to said high pressure and introduce the top liquid at the top of the high pressure distillation column; and a fifth conduit for withdrawing product nitrogen from the top of the high pressure distillation column.

6. The process of claim 1, wherein the step of heating said waste vapor stream, and expanding said heated stream to produce power comprises the steps of heating a first portion of said waste vapor stream to a first temperature to form a heated first stream, and expanding said heated first stream in a first expander to produce power, and heating a second portion of said waste stream further to a second temperature to form a heated second stream, and expanding said heated second stream in a second expander to produce power.

7. The process of claim 6, wherein at least a portion of said power is used by said cold compressor.

8. The apparatus of claim 5, wherein the heat exchanger further comprises the second exchange line.

9. The apparatus of claim 3, wherein the first heat exchanger and the second heat exchanger are integrated into a single heat exchange unit.

* * * * *